US011114013B2

(12) United States Patent
Li et al.

(10) Patent No.: US 11,114,013 B2
(45) Date of Patent: Sep. 7, 2021

(54) DISPLAY DRIVING DEVICE, DISPLAY DRIVING METHOD, DISPLAY MODULE AND DISPLAY DEVICE

(71) Applicants: HEFEI BOE DISPLAY TECHNOLOGY CO., LTD., Anhui (CN); BOE TECHNOLOGY GROUP CO., LTD., Beijing (CN)

(72) Inventors: Qing Li, Beijing (CN); Liugang Zhou, Beijing (CN); Ke Dai, Beijing (CN); Yizhan Han, Beijing (CN); Liu He, Beijing (CN); Yunyun Liang, Beijing (CN); Jun Wang, Beijing (CN); Zhenlin Qu, Beijing (CN); Jianwei Sun, Beijing (CN); Yulong Xiong, Beijing (CN); Tao Li, Beijing (CN); Yu Quan, Beijing (CN); Xiaofeng Yin, Beijing (CN); Qian Zhou, Beijing (CN); Pengjun Fang, Beijing (CN)

(73) Assignees: HEFEI BOE DISPLAY TECHNOLOGY CO., LTD., Hefei (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/094,737

(22) Filed: Nov. 10, 2020

(65) Prior Publication Data

US 2021/0150962 A1 May 20, 2021

(30) Foreign Application Priority Data

Nov. 20, 2019 (CN) ..... 201911140975.3

(51) Int. Cl.
*G09G 3/20* (2006.01)

(52) U.S. Cl.
CPC ..... *G09G 3/20* (2013.01); *G09G 2310/027* (2013.01); *G09G 2320/0276* (2013.01)

(58) Field of Classification Search
CPC ..... G09G 3/20; G09G 2310/027; G09G 2320/0276
See application file for complete search history.

(56) References Cited

U.S. PATENT DOCUMENTS

2009/0015601 A1* 1/2009 Kim ..... G09G 3/342 345/690
2011/0069098 A1* 3/2011 Lee ..... G09G 3/3225 345/691
2019/0114971 A1* 4/2019 Choi ..... G09G 3/2014

* cited by examiner

*Primary Examiner* — Muhammad N Edun
(74) *Attorney, Agent, or Firm* — McCoy Russell LLP

(57) ABSTRACT

A display driving device, a display driving method, a display module and a display device are provided. The display driving device includes: a PWM signal generating circuit configured to generate a PWM signal; a PWM signal acquisition circuit, configured to identify whether the PWM signal output by the PWM signal generating circuit is at a high level or a low level; a gamma voltage debugging circuit, configured to debug a gamma voltage to obtain a first group of gamma voltage reference data corresponding to the PWM signal at the high level and a second group of gamma voltage reference data corresponding to the PWM signal at the low level in each gray-scale image; and a gamma voltage switching circuit.

10 Claims, 3 Drawing Sheets

DISPLAY DRIVING DEVICE, DISPLAY DRIVING METHOD, DISPLAY MODULE AND DISPLAY DEVICE

CROSS REFERENCE OF RELATED APPLICATION

The present application claims priority to Chinese Patent Application No. 201911140975.3 filed on Nov. 20, 2019. The entire contents of the above-listed application are hereby incorporated by reference for all purposes.

TECHNICAL FIELD

The present disclosure relates to the field of display technologies, and in particular, to a display driving device, a display driving method, a display module and a display device.

BACKGROUND

With the rapid development of the display panel field, the demand for large-sized high-resolution display panel is increasing day by day, and the requirements for the display effect of display panel products are higher. As the size and resolution of display panel produced by advanced lines are increased, the display panel process is challenged. Currently, most of the backlight systems of display devices such as TVs and the like adopt the Pulse Width Modulation (PWM) to control a brightness, the backlight source performs a high and low level switching according to a certain frequency and duty ratio, and the backlight brightness is controlled by adjusting the duty ratio, which is higher in frequency and cannot be recognized by human eyes. However, the backlight system adopts the PWM to control the brightness, which may cause the display panel to have a waterfall defect.

SUMMARY

A display driving device is provided in the present disclosure, including:

a Pulse Width Modulation (PWM) signal generating circuit configured to generate a PWM signal;

a PWM signal acquisition circuit, connected to the PWM signal generating circuit, and configured to identify whether the PWM signal output by the PWM signal generating circuit is at a high level or a low level;

a gamma voltage debugging circuit, configured to debug a gamma voltage to obtain a first group of gamma voltage reference data corresponding to the PWM signal at the high level and a second group of gamma voltage reference data corresponding to the PWM signal at the low level in each gray-scale image in a case that an actual voltage value of a pixel voltage corresponding to the PWM signal at the high level is the same with an actual voltage value of the pixel voltage corresponding to the PWM signal at the low level; and a gamma voltage switching circuit, connected to the PWM signal acquisition circuit, the PWM signal generating circuit and the gamma voltage debugging circuit, and configured to store the first group of gamma voltage reference data and the second group of gamma voltage reference data, output the first group of gamma voltage reference data to a source driver in a case that the PWM signal acquisition circuit determines that the PWM signal is at the high level, and output the second group of gamma voltage reference data to the source driver in a case that the PWM signal acquisition circuit determines that the PWM signal is at the low level.

Optionally, the gamma voltage debugging circuit includes:

a determining sub-circuit, configured to determine: a first group of gamma voltage data corresponding to different gray-scale images in the case that the PWM signal is at the high level;

a debugging sub-circuit, configured to debug the gamma voltages in different gray-scale images in the case that the PWM signal is at the low level, to obtain gamma voltage data in a case that the actual voltage value of the pixel voltage is the same with the actual voltage value of the pixel voltage corresponding to the PWM signal at the high level, and takes the gamma voltage data as the second group of gamma voltage data.

Optionally, the determining sub-circuit includes:

a first determining sub-circuit, configured to determine transmittances corresponding to the different gray-scale images;

a second determining sub-circuit, configured to determine the gamma voltages corresponding to the different gray-scale images; and a third determining sub-circuit, configured to determine the gamma voltages corresponding to the transmittances in the different gray-scale images to obtain the first group of gamma voltage data.

Optionally, the debugging sub-circuit is configured to:

determine gamma reference data in the different gray-scale images in a case that the first group of gamma voltage reference data corresponds to the high level of the PWM signal;

debug the gamma voltage corresponding to the PWM signal at the low level in the corresponding gray-scale until image brightness of all gray-scale images are the same with an image brightness in the gray-scale image corresponding to the PWM signal at the high level, to obtain the second group of gamma voltage reference data.

A display driving method is further provided in the present disclosure, including:

debugging a gamma voltage to obtain a first group of gamma voltage reference data corresponding to the PWM signal at the high level and a second group of gamma voltage reference data corresponding to the PWM signal at the low level in each gray-scale image in a case that an actual voltage value of a pixel voltage corresponding to the PWM signal at the high level is the same with an actual voltage value of the pixel voltage corresponding to the PWM signal at the low level;

storing the first group of gamma voltage reference data and the second group of gamma voltage reference data;

identifying whether the PWM signal output by the PWM signal generating circuit is at a high level or a low level;

outputting the first group of gamma voltage reference data to a source driver in a case that the PWM signal acquisition circuit determines that the PWM signal is at the high level, and outputting the second group of gamma voltage reference data to the source driver in a case that the PWM signal acquisition circuit determines that the PWM signal is at the low level.

Optionally, the debugging the gamma voltage to obtain the first group of gamma voltage reference data corresponding to the PWM signal at the high level and the second group of gamma voltage reference data corresponding to the PWM signal at the low level in each gray-scale image in the case that the actual voltage value of the pixel voltage corresponding to the PWM signal at the high level is the same with the actual voltage value of the pixel voltage corresponding to the PWM signal at the low level further includes:

determining a first group of gamma voltage data corresponding to different gray-scale images in the case that the PWM signal is at the high level;

debugging the gamma voltages in different gray-scale images in the case that the PWM signal is at the low level, to obtain gamma voltage data in a case that the actual voltage value of the pixel voltage is the same with the actual voltage value of the pixel voltage corresponding to the PWM signal at the high level, and taking the gamma voltage data as the second group of gamma voltage data.

Optionally, the determining the first group of gamma voltage data corresponding to the different gray-scale images in the case that the PWM signal is at the high level further includes:

determining transmittances corresponding to the different gray-scale images;

determining the gamma voltages corresponding to the different gray-scale images; and determining the gamma voltages corresponding to the transmittances in the different gray-scale images to obtain the first group of gamma voltage data.

Optionally, the debugging the gamma voltages in the different gray-scale images in the case that the PWM signal is at the low level, to obtain gamma voltage data in the case that the actual voltage value of the pixel voltage is the same with the actual voltage value of the pixel voltage corresponding to the PWM signal at the high level and taking the gamma voltage data as the second group of gamma voltage data further includes:

determining the gamma reference data in the different gray-scale images in the case that the first group of gamma voltage reference data corresponds to the high level of the PWM signal;

debugging the gamma voltage corresponding to the PWM signal at the low level in the corresponding gray-scale until image brightness of all gray-scale images are the same with an image brightness in the gray-scale image corresponding to the PWM signal at the high level, to obtain the second group of gamma voltage reference data.

A display module including the display driving device hereinabove is further provided in the present disclosure.

A display device including the display module hereinabove is further provided in the present disclosure.

DETAILED DESCRIPTION

To make the objects, technical solutions and advantages of some embodiments of the present disclosure more apparent, some embodiments of the present disclosure will be described in detail and completely below with reference to the drawings. It is to be understood that the described embodiments are only a few embodiments of the present disclosure, and not all embodiments. All other embodiments, which can be derived by a person skilled in the art from the described embodiments of the disclosure without creative work, are within the scope of the disclosure.

Unless defined otherwise, technical or scientific terms used herein shall have the ordinary meaning as understood by one of ordinary skill in the art to which this disclosure belongs. The use of "first," "second," and the like in this disclosure is not intended to indicate any order, quantity, or importance, but rather is used to distinguish one element from another. Also, the use of the terms "a," "an," or "the" and similar referents do not denote a limitation of quantity, but rather denote the presence of at least one. The word "including" or "includes", and the like, means that the element or item preceding the word includes the element or item listed after the word and its equivalent, but does not exclude other elements or items. The terms "connected" or "coupled" and the like are not restricted to physical or mechanical connections, but may include electrical connections, whether direct or indirect. "upper", "lower", "left", "right", and the like are used only to indicate relative positional relationships, and when the absolute position of the object being described is changed, the relative positional relationships may also be changed accordingly.

Figure 1:
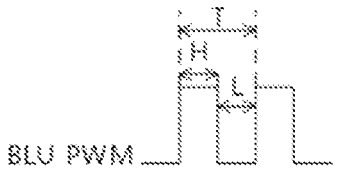
FIG. 1 is a schematic view of a signal for adjusting a backlight brightness through a backlight PWM.

Before the detailed description of the display driving device, the display driving method thereof, the display module and the display device provided in some embodiments of the present disclosure, the following description is necessary:

currently, most of the backlight systems of display devices such as TVs adopt PWM (Pulse Width Modulation) to control the brightness, and the principle of PWM to adjust the backlight brightness is as follows: under a certain frequency condition, the backlight brightness is adjusted by changing the output duty ratio, as shown in FIG. 1, the period of the backlight PWM is T, in one period T, the high level time is H, and the backlight is in a bright state; the low level time is L, the backlight is in a dark state, human eyes cannot recognize bright-dark switching due to high frequency, and only the overall brightness can be sensed, and the backlight brightness is changed by adjusting the duty ratio of high level and low level, so that the overall brightness is higher when the H ratio is higher, and is lower on the contrary. However, in the bright state and the dark state of the backlight, the presence or absence of illumination affects the characteristics of the conductors of the Active (Array Active) layer of the Array, and the resistance-capacitance Delay (RC Delay) of the Data line signal voltage (Data voltage) is different, so that the charging rate of the panel is different, and a slow moving transverse Waterfall occurs, and the picture display effect is affected. The waterfall defect refers to the appearance of slowly moving or stationary transverse blocks in a monochrome low grayscale image. In a frame, when the PWM signal is at a high-level H, a corresponding display panel scanning area appears as a dark transverse Block; when the PWM signal is at the low level L, the corresponding scan region of the display panel appears as a bright transverse Block.

Figure 2:
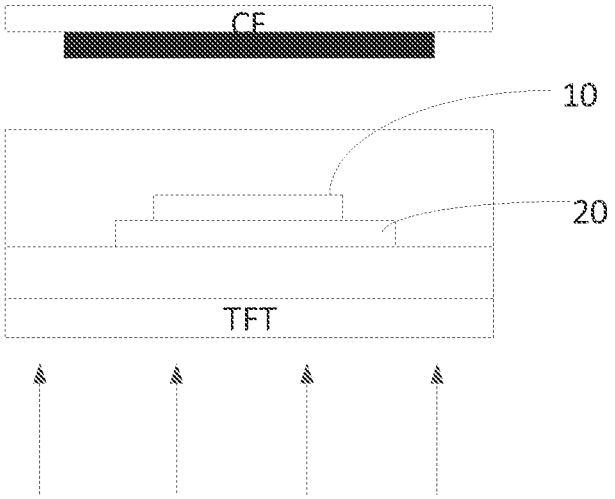
FIG. 2 is a schematic view showing a difference of a RC Delay of a Data voltage caused by a conductivity difference of an array active layer when a backlight emits light and does not emit light.

The bright and dark states of the backlight affect the display panel: when the backlight is in a bright state, the illumination affects the conductor characteristics of the Array Active layer. FIG. 2 is a schematic view showing a difference of a RC Delay of a Data voltage caused by a conductivity difference of an array active layer when a backlight emits light or not. As shown in FIG. 2, the Array Active layer 20 under the Data line 10 has the conductor characteristics under the illumination, so that a resistance-capacitance Delay (RC Delay) of the signal voltage of the Data line (Data voltage) may be different when the backlight emits light and does not emit light.

Figure 3:
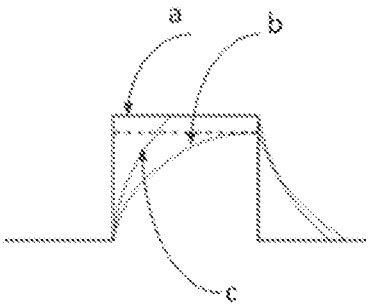
FIG. 3 is a schematic view shows a difference of a Data voltage caused by a RC delay of the Data voltage when a backlight emits light and does not emit light, where a curve is a Data voltage curve in an ideal state, b curve is a Data voltage curve when the backlight emits light, and c curve is a Data voltage curve when the backlight does not emit light.

Specifically, FIG. 3 is a schematic view shows a difference of a Data voltage caused by a RC delay of the Data voltage when a backlight emits light and does not emit light, where a curve is a Data voltage curve in an ideal state, b curve is a Data voltage curve when the backlight emits light, and c curve is a Data voltage curve when the backlight does not emit light. Referring to FIG. 3, due to the pixel electrode coupling capacitance (i.e., the coupling capacitance between the pixel electrode and the Data line), there is a resistance-capacitance Delay (RC Delay) when the Data line signal voltage (Data voltage) is charged. When the backlight emits light, the array active layer 20 is not conductive, the RC Delay is small, the pixel charging time is sufficient, the charging rate is high, the actual pixel voltage is high, and the brightness of the corresponding area of the panel is high; under the same Data line signal voltage (Data voltage), when the backlight emits light, the array active layer 20 is turned on to form a capacitive impedance, the RC Delay is relatively serious, the pixel charging time is shorter than that when the backlight does not emit light, the actual pixel voltage is relatively low, and the brightness of the corresponding area of the panel is relatively low (as shown in FIG. 3 where a curve b and a curve c shows the actual pixel voltage difference caused by the RC Delay when the backlight emits light or does not emit light), so that a transverse Block caused by the brightness difference appears on the panel, namely, the waterfall defect occurs.

In view of this, a display driving device, a display driving method, a display module and a display device are provided in some embodiments of the present disclosure, to avoid the waterfall defect.

Figure 4:
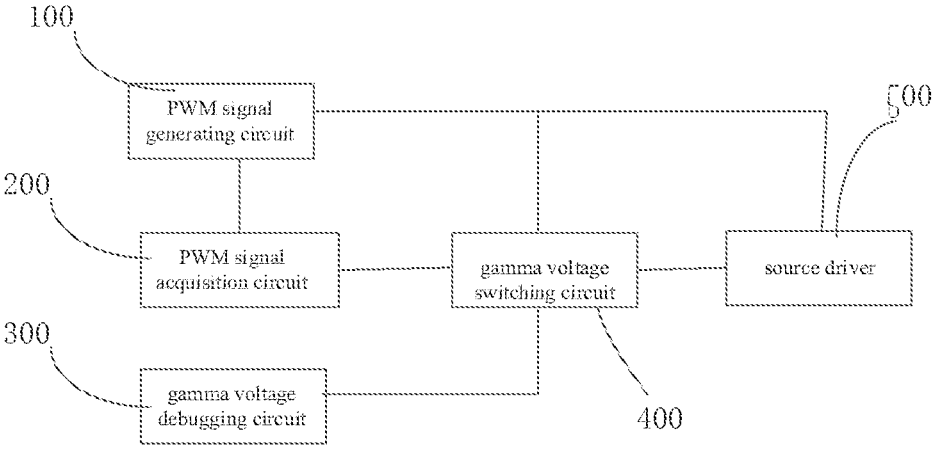
FIG. 4 is a schematic view of a display driving device in some embodiments of the present disclosure.

As shown in FIG. 4, a display driving device is provide in some embodiments of the present disclosure, including:

a Pulse Width Modulation (PWM) signal generating circuit 100 configured to generate a PWM signal;

a PWM signal acquisition circuit 200, connected to the PWM signal generating circuit 100, and configured to identify whether the PWM signal output by the PWM signal generating circuit 100 is at a high level or a low level;

a gamma voltage debugging circuit 300, configured to debug a gamma voltage to obtain a first group of gamma voltage reference data corresponding to the PWM signal at the high level and a second group of gamma voltage reference data corresponding to the PWM signal at the low level in each gray-scale image in a case that an actual voltage value of a pixel voltage corresponding to the PWM signal at the high level is the same with an actual voltage value of the pixel voltage corresponding to the PWM signal at the low level; and a gamma voltage switching circuit 400, connected to the PWM signal acquisition circuit 200, the PWM signal generating circuit 100 and the gamma voltage debugging circuit 300, and configured to store the first group of gamma voltage reference data and the second group of gamma voltage reference data, output the first group of gamma voltage reference data to a source driver 500 in a case that the PWM signal acquisition circuit 200 determines that the PWM signal is at the high level, and output the second group of gamma voltage reference data to the source driver 500 in a case that the PWM signal acquisition circuit 200 determines that the PWM signal is at the low level.

In the above scheme, the pixel voltage refers to a voltage difference between the pixel electrode and the common electrode. According to the above embodiment of the present disclosure, the gamma voltage debugging circuit 300 is used to debug the gamma voltage to obtain a first group of gamma voltage reference data and a second group of gamma voltage reference data, where the first group of gamma voltage reference data is transmitted to the source driver 500 when the PWM signal is at the high level, the second group of gamma voltage reference data is transmitted to the source driver 500 when the PWM signal is at the low level. In each gray-scale image, an actual voltage value of the pixel voltage when the PWM signal is at the high level is the same as an actual voltage value of the pixel voltage when the PWM signal is at the low level; the gamma voltage switching circuit 400 pre-stores the first and second groups of gamma voltage reference data; the PWM signal acquisition circuit 200 identifies the PWM signal as a high level or a low level, and the gamma voltage in the corresponding level and output by the Source Driver 500 is dynamically adjusted, so that the actual voltage value of the pixel voltage in the dark state is equal to the actual voltage value of the pixel voltage in the bright state, thereby eliminating the difference of the signal voltage (Data voltage) RC Delay of the Data line in the dark state and the bright state, avoiding the waterfall defect, and finally improving the picture display effect.

Figure 5:
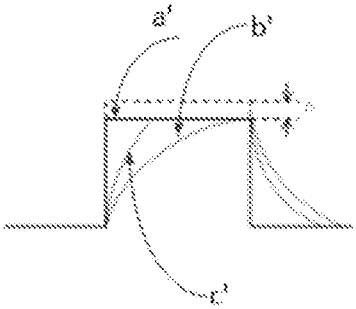
FIG. 5 is a schematic view shows a difference of a Data voltage caused by a RC delay of the Data voltage when a backlight emits light and does not emit light in a display driving device and a display driving method in some embodiments of the present disclosure, where a' curve is a Data voltage curve in an ideal state, b' curve is a Data voltage curve when the backlight emits light, and c' curve is a Data voltage curve when the backlight does not emit light.

The principle of avoiding the waterfall defect through adjusting the gamma is:

the Gamma voltage (Gamma) is a reference voltage configured to generate a gray-scale voltage, and when the backlight PWM signal is at a low level (backlight dark state), the pixel voltage charging rate is high, the actual pixel voltage value is large, and the brightness is high; when the backlight PWM is at a high level (backlight bright state), under the same gray-scale voltage, the charging rate of the pixel is low, the actually achieved pixel voltage value is small, the brightness is low, and finally alternately light and dark transverse Blocks are formed. According to the present disclosure, when the PWM signal is at the high level and the low level, different gray-scale gamma voltages are respectively applied to the Data lines of the pixels. As shown in FIG. 5, a curve is a Data voltage curve in an ideal state, b curve is a Data voltage curve when the backlight emits light, and c curve is a Data voltage curve when the backlight does not emit light. When the PWM signal is at the low level, the gray-scale gamma voltage is low (A in FIG. 5 represents the decreased value of gamma voltage), so the actually reached voltage value of the pixel voltage decreases. By adjusting the gamma voltage values in respective gray scales, the actual pixel voltage in the case of high level and low level is not changed, thereby realizing a uniform brightness and eliminating the waterfall defect.

In some embodiments of the present disclosure, the gamma voltage debugging circuit 300 includes:

a determining sub-circuit, configured to determine: a first group of gamma voltage data corresponding to different gray-scale images in the case that the PWM signal is at the high level;

a debugging sub-circuit, configured to debug the gamma voltages in different gray-scale images in the case that the PWM signal is at the low level, to obtain gamma voltage data in a case that the actual voltage value of the pixel voltage is the same with the actual voltage value of the pixel voltage corresponding to the PWM signal at the high level, and takes the gamma voltage data as the second group of gamma voltage data.

In the above embodiments, the method for obtaining two groups of gamma voltage reference data through the debugging of the gamma voltage debugging circuit 300 includes: after determining one group of gamma voltage reference data, the gamma voltage debugging circuit 300 adjusts another group of corresponding gray level gamma voltages in different gray-scale images, until the waterfall defects disappear in all gray-scale images, to obtain another group of gamma voltage reference data.

In some embodiments of the present disclosure, the determining sub-circuit includes:

a first determining sub-circuit, configured to determine transmittances corresponding to the different gray-scale images;

a second determining sub-circuit, configured to determine the gamma voltages corresponding to the different gray-scale images; and a third determining sub-circuit, configured to determine the gamma voltages corresponding to the transmittances in the different gray-scale images to obtain the first group of gamma voltage data.

According to the above embodiments, the first group of gamma voltage reference data may be determined by: controlling the PWM signal to be at the high level (namely, the backlight emits light), and obtaining the transmittance corresponding to each gray-scale according to a Gamma2.2 curve; and obtaining the gray-scale corresponding to the gamma voltage, according to the S-IC specification, and further obtaining the transmittance corresponding to the specific gray-scale.

As shown in Table 1, taking 8 bit, 18 gamma voltages as an example, the gamma voltage value corresponding to the corresponding transmittance is determined through a V-T curve, then a group of gamma voltage reference data H1-H18 is determined, which is the first group of gamma voltage reference data corresponding to the backlight PWM signal at the high level.

Further, in some embodiments of the present disclosure, the debug sub-circuit is configured to:

determine gamma reference data in the different gray-scale images in a case that the first group of gamma voltage reference data corresponds to the high level of the PWM signal;

debug the gamma voltage corresponding to the PWM signal at the low level in the corresponding gray-scale until image brightness of all gray-scale images are the same with an image brightness in the gray-scale image corresponding to the PWM signal at the high level, to obtain the second group of gamma voltage reference data.

According to the above embodiments, the second group of gamma voltage reference data is determined by the following method:

fixing the first group of gamma voltage reference data, and debugging the corresponding gamma voltage at the low level in the corresponding gray-scale until the image brightness in all gray-scale images are the same as the image brightness in the gray-scale image corresponding to the PWM signal at the high level, namely until the waterfall defects in all the gray-scales disappears, thereby obtaining a group of gamma voltage reference data L1-L18, namely the second group of gamma voltage reference data corresponding to the PWM signal at the low level.

TABLE 1 two groups of gamma voltage debugging and comparison tables

| gray-scale | Gamma | Gamma-H | Gamma-L | Gamma | Gamma-H | Gamma-L |
|---|---|---|---|---|---|---|
| L0 | V1 | H1 | L1 | V18 | H18 | L18 |
| L1 | V2 | H2 | L2 | V17 | H17 | L17 |
| L31 | V3 | H3 | L3 | V16 | H16 | L16 |
| L63 | V4 | H4 | L4 | V15 | H15 | L15 |
| L127 | V5 | H5 | L5 | V14 | H14 | L14 |
| L191 | V6 | H6 | L6 | V13 | H13 | L13 |
| L223 | V7 | H7 | L7 | V12 | H12 | L12 |
| L254 | V8 | H8 | L8 | V11 | H11 | L11 |
| L255 | V9 | H9 | L9 | V10 | H10 | L10 |

According to the above embodiment of the present disclosure, the gamma voltage debugging circuit 300 is configured to debug the gamma voltage to obtain a first group of gamma voltage reference data and a second group of gamma voltage reference data, where the first group of gamma voltage reference data is transmitted to the source driver 500 when the PWM signal is at the high level, the second group of gamma voltage reference data is transmitted to the source driver 500 when the PWM signal is at the low level, and an actual voltage value of the pixel voltage when the PWM signal is at the high level is the same as an actual voltage value of the pixel voltage when the PWM signal is at the low level in each gray-scale image; the gamma voltage switching circuit 400 pre-stores the first and second groups of gamma voltage reference data; the PWM signal acquisition circuit 200 identifies whether the PWM signal is at the high level or the low level, and dynamically adjusts the gamma voltage at the corresponding level which is output by the Source Driver 500, so that the actual voltage value of the pixel voltage in the dark state is equal to the actual voltage value of the pixel voltage in the bright state, thereby eliminating the difference of the signal voltage (Data voltage) RC Delay of the Data line in the dark state and the bright state, avoiding the waterfall defects, and finally improving the image display effect.

Figure 6:
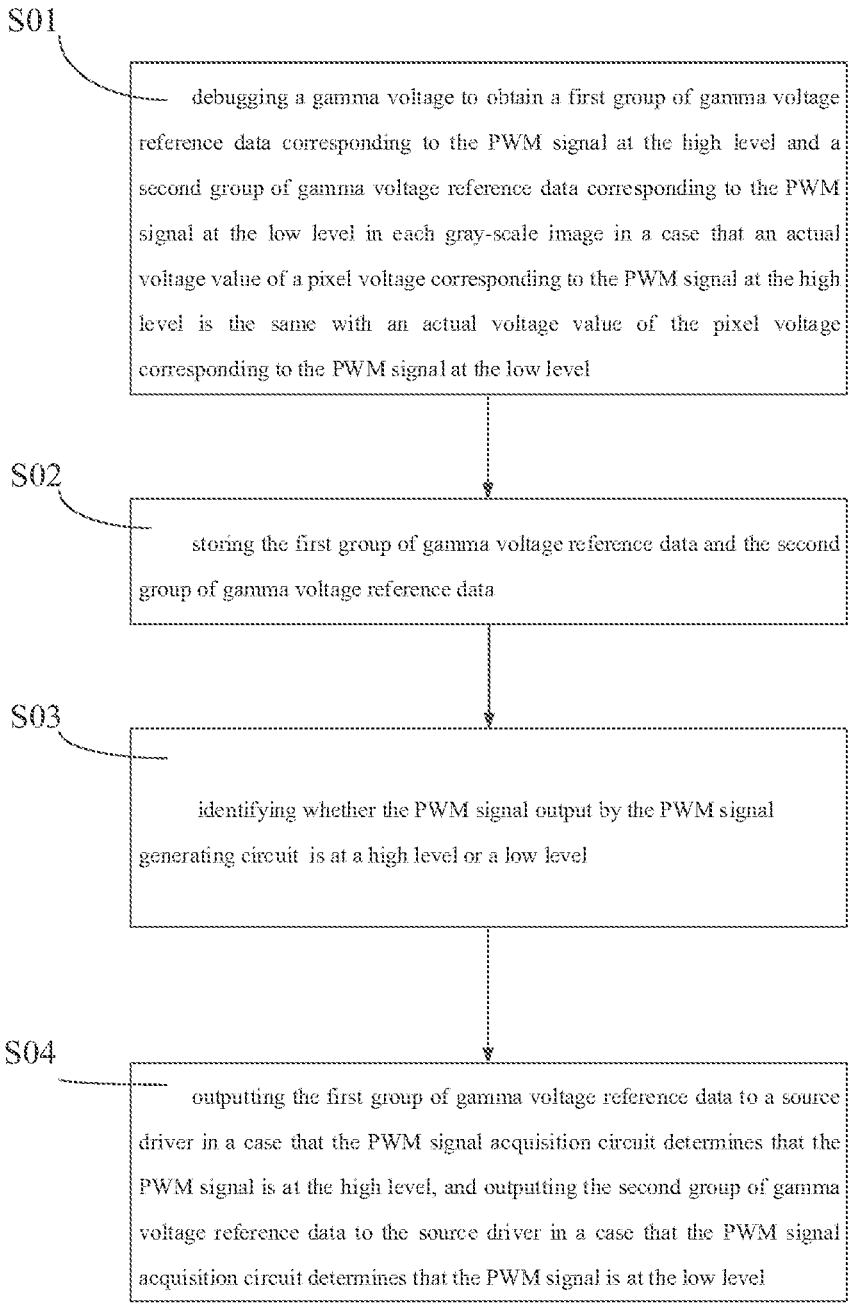
FIG. 6 is a flow chart of a display driving method in some embodiments of the present disclosure.

A display driving method is further provided in some embodiments of the present disclosure, as shown in FIG. 6, the method includes:

Step S01: debugging a gamma voltage to obtain a first group of gamma voltage reference data corresponding to the PWM signal at the high level and a second group of gamma voltage reference data corresponding to the PWM signal at the low level in each gray-scale image in a case that an actual voltage value of a pixel voltage corresponding to the PWM signal at the high level is the same with an actual voltage value of the pixel voltage corresponding to the PWM signal at the low level;

Step S02: storing the first group of gamma voltage reference data and the second group of gamma voltage reference data;

Step S03: identifying whether the PWM signal output by the PWM signal generating circuit 100 is at a high level or a low level;

Step S04: outputting the first group of gamma voltage reference data to a source driver 500 in a case that the PWM signal acquisition circuit 200 determines that the PWM signal is at the high level, and outputting the second group of gamma voltage reference data to the source driver 500 in a case that the PWM signal acquisition circuit 200 determines that the PWM signal is at the low level.

According to the above embodiment of the present disclosure, the gamma voltage debugging circuit 300 is configured to debug the gamma voltage to obtain a first group of gamma voltage reference data and a second group of gamma voltage reference data, where the first group of gamma voltage reference data is transmitted to the source driver 500 when the PWM signal is at the high level, the second group of gamma voltage reference data is transmitted to the source driver 500 when the PWM signal is at the low level, and an actual voltage value of the pixel voltage when the PWM signal is at the high level is the same as an actual voltage value of the pixel voltage when the PWM signal is at the low level in each gray-scale image; the gamma voltage switching circuit 400 pre-stores the first and second groups of gamma voltage reference data; the PWM signal acquisition circuit 200 identifies whether the PWM signal is at the high level or the low level, and dynamically adjusts the gamma voltage at the corresponding level which is output by the Source Driver 500, so that the actual voltage value of the pixel voltage in the dark state is equal to the actual voltage value of the pixel voltage in the bright state, thereby eliminating the difference of the signal voltage (Data voltage) RC Delay of the Data line in the dark state and the bright state, avoiding the waterfall defects, and finally improving the image display effect.

The principle of avoiding the waterfall defect through adjusting the gamma is:

the Gamma voltage (Gamma) is a reference voltage configured to generate a gray-scale voltage, and when the backlight PWM signal is at a low level (backlight dark state), the pixel voltage charging rate is high, the actual pixel voltage value is large, and the brightness is high; when the backlight PWM is at a high level (backlight bright state), under the same gray-scale voltage, the charging rate of the pixel is low, the actually achieved pixel voltage value is small, the brightness is low, and finally alternately light and dark transverse Blocks are formed. According to the present disclosure, when the PWM signal is at the high level and the low level, different gray-scale gamma voltages are respectively applied to the Data lines of the pixels. As shown in FIG. 5, a curve is a Data voltage curve in an ideal state, b curve is a Data voltage curve when the backlight emits light, and c curve is a Data voltage curve when the backlight does not emit light. When the PWM signal is at the low level, the gray-scale gamma voltage is low (A in FIG. 4 represents the decreased value of gamma voltage), so the actually reached voltage value of the pixel voltage decreases. By adjusting the gamma voltage values in respective gray scales, the actual pixel voltage in the case of high level and low level is not changed, thereby realizing a uniform brightness and eliminating the waterfall defect.

In the above method, the step S01 further includes:

step S011, determining a first group of gamma voltage data corresponding to different gray-scale images when the PWM signal is at a high level;

step S012, debugging the gamma voltages in different gray-scale images when the PWM signal is at the low level to obtain gamma voltage data corresponding to the actual voltage value of the pixel voltage being the same as the actual voltage value of the pixel voltage when the PWM dimming signal is at the high level, as the second group of gamma voltage data.

In the above scheme, the specific method for obtaining two sets of gamma voltage reference data through the debugging of the gamma voltage debugging circuit 300 is to adjust another set of corresponding gray level gamma voltages under different gray-scale images by using the gamma voltage debugging circuit 300 under the condition of determining one set of gamma voltage reference data until waterfall defects disappear under all gray-scale images to obtain another set of gamma voltage reference data.

The step S011 further includes:

Step S011: determining a first group of gamma voltage data corresponding to different gray-scale images in the case that the PWM signal is at the high level;

Step S012: debugging the gamma voltages in different gray-scale images in the case that the PWM signal is at the low level, to obtain gamma voltage data in a case that the actual voltage value of the pixel voltage is the same with the actual voltage value of the pixel voltage corresponding to the PWM signal at the high level, and taking the gamma voltage data as the second group of gamma voltage data.

In the above embodiments, the method for obtaining two groups of gamma voltage reference data through the debugging of the gamma voltage debugging circuit 300 includes: after determining one group of gamma voltage reference data, the gamma voltage debugging circuit 300 adjusts another group of corresponding gray level gamma voltages in different gray-scale images, until the waterfall defects disappear in all gray-scale images, to obtain another group of gamma voltage reference data.

The step S012 further includes:

determining transmittances corresponding to the different gray-scale images;

determining the gamma voltages corresponding to the different gray-scale images; and determining the gamma voltages corresponding to the transmittances in the different gray-scale images to obtain the first group of gamma voltage data.

According to the above embodiments, the second group of gamma voltage reference data is determined by the following method: fixing the first group of gamma voltage reference data, and debugging the corresponding gamma voltage at the low level in the corresponding gray-scale until the image brightness in all gray-scale images are the same as the image brightness in the gray-scale image corresponding to the PWM signal at the high level, namely until the waterfall defects in all the gray-scales disappears, thereby obtaining a group of gamma voltage reference data L1-L18, namely the second group of gamma voltage reference data corresponding to the PWM signal at the low level.

According to the above embodiment of the present disclosure, the gamma voltage debugging circuit 300 is configured to debug the gamma voltage to obtain a first group of gamma voltage reference data and a second group of gamma voltage reference data, where the first group of gamma voltage reference data is transmitted to the source driver 500 when the PWM signal is at the high level, the second group of gamma voltage reference data is transmitted to the source driver 500 when the PWM signal is at the low level, and an actual voltage value of the pixel voltage when the PWM signal is at the high level is the same as an actual voltage value of the pixel voltage when the PWM signal is at the low level in each gray-scale image; the gamma voltage switching circuit 400 pre-stores the first and second groups of gamma voltage reference data; the PWM signal acquisition circuit 200 identifies whether the PWM signal is at the high level or the low level, and dynamically adjusts the gamma voltage at the corresponding level which is output by the Source Driver 500, so that the actual voltage value of the pixel voltage in the dark state is equal to the actual voltage value of the pixel voltage in the bright state, thereby eliminating the difference of the signal voltage (Data voltage) RC Delay of the Data line in the dark state and the bright state, avoiding the waterfall defects, and finally improving the image display effect.

A display module including the display driving device hereinabove is further provided in some embodiments of the present disclosure.

A display device including the display module hereinabove is further provided in some embodiments of the present disclosure.

It should be noted that the display device provided in some embodiments of the present disclosure may be various display devices including a mobile phone, a computer, a display, a television, and the like.

The following points need to be explained:

(1) the drawings relate only to structures related to some embodiments of the disclosure, and other structures may refer to general designs.

(2) In the drawings used to describe embodiments of the disclosure, the thickness of layers or regions are exaggerated or reduced for clarity, i.e., the drawings are not necessarily to scale. It will be understood that when an element such as a layer, film, region or substrate is referred to as being "on" or "under" another element, it can be "directly on" or "under" the other element or intervening elements may be present.

(3) Without conflict, embodiments of the present disclosure and features of the embodiments may be combined with each other to arrive at new embodiments.

The above description is only some embodiments of the present disclosure, but the scope of the present disclosure is not limited thereto, and the scope of the present disclosure should be subject to the scope of the claims.

The invention claimed is:

1. A display driving device, comprising:

a Pulse Width Modulation (PWM) signal generating circuit configured to generate a PWM signal;

a PWM signal acquisition circuit, connected to a PWM signal generating circuit, and configured to identify whether a PWM signal output by the PWM signal generating circuit is at a high level or a low level;

a gamma voltage debugging circuit, configured to debug a gamma voltage to obtain a first group of gamma voltage reference data corresponding to the PWM signal at the high level and a second group of gamma voltage reference data corresponding to the PWM signal at the low level in each gray-scale image in a case that an actual voltage value of a pixel voltage corresponding to the PWM signal at the high level is the same with an actual voltage value of the pixel voltage corresponding to the PWM signal at the low level; and a gamma voltage switching circuit, connected to the PWM signal acquisition circuit, the PWM signal generating circuit and the gamma voltage debugging circuit, and configured to store the first group of gamma voltage reference data and the second group of gamma voltage reference data, output the first group of gamma voltage reference data to a source driver in a case that the PWM signal acquisition circuit determines that the PWM signal is at the high level, and output the second group of gamma voltage reference data to the source driver in a case that the PWM signal acquisition circuit determines that the PWM signal is at the low level.

2. The display driving device according to claim 1, wherein the gamma voltage debugging circuit comprises:

a determining sub-circuit, configured to determine: a first group of gamma voltage data corresponding to different gray-scale images in the case that the PWM signal is at the high level;

a debugging sub-circuit, configured to debug gamma voltages in different gray-scale images in the case that the PWM signal is at the low level, to obtain gamma voltage data in a case that the actual voltage value of the pixel voltage is the same with the actual voltage value of the pixel voltage corresponding to the PWM signal at the high level, and takes the gamma voltage data as the second group of gamma voltage data.

3. The display driving device according to claim 2, wherein the determining sub-circuit comprises:

a first determining sub-circuit, configured to determine transmittances corresponding to the different gray-scale images;

a second determining sub-circuit, configured to determine the gamma voltages corresponding to the different gray-scale images; and a third determining sub-circuit, configured to determine the gamma voltages corresponding to the transmittances in the different gray-scale images to obtain the first group of gamma voltage data.

4. The display driving device according to claim 3, wherein the debugging sub-circuit is configured to:

determine gamma reference data in the different gray-scale images in a case that the first group of gamma voltage reference data corresponds to the high level of the PWM signal;

debug the gamma voltage corresponding to the PWM signal at the low level in a corresponding gray-scale until image brightness of all gray-scale images are the same with an image brightness in the gray-scale image corresponding to the PWM signal at the high level, to obtain the second group of gamma voltage reference data.

5. A display module comprising the display driving device according to claim 1.

6. A display device comprising the display module according to claim 5.

7. A display driving method, comprising:

debugging a gamma voltage to obtain a first group of gamma voltage reference data corresponding to the PWM signal at the high level and a second group of gamma voltage reference data corresponding to the PWM signal at the low level in each gray-scale image in a case that an actual voltage value of a pixel voltage corresponding to the PWM signal at the high level is the same with an actual voltage value of the pixel voltage corresponding to the PWM signal at the low level;

storing the first group of gamma voltage reference data and the second group of gamma voltage reference data;

identifying whether the PWM signal output by the PWM signal generating circuit is at a high level or a low level; and outputting the first group of gamma voltage reference data to a source driver in a case that the PWM signal acquisition circuit determines that the PWM signal is at the high level, and outputting the second group of gamma voltage reference data to the source driver in a case that the PWM signal acquisition circuit determines that the PWM signal is at the low level.

8. The display driving method according to claim 7, wherein the debugging the gamma voltage to obtain the first group of gamma voltage reference data corresponding to the PWM signal at the high level and the second group of gamma voltage reference data corresponding to the PWM signal at the low level in each gray-scale image in the case that the actual voltage value of the pixel voltage corresponding to the PWM signal at the high level is the same with the actual voltage value of the pixel voltage corresponding to the PWM signal at the low level further comprises:

determining a first group of gamma voltage data corresponding to different gray-scale images in the case that the PWM signal is at the high level;

debugging the gamma voltages in different gray-scale images in the case that the PWM signal is at the low level, to obtain gamma voltage data in a case that the actual voltage value of the pixel voltage is the same with the actual voltage value of the pixel voltage corresponding to the PWM signal at the high level, and taking the gamma voltage data as the second group of gamma voltage data.

9. The display driving method according to claim 8, wherein the determining the first group of gamma voltage data corresponding to the different gray-scale images in the case that the PWM signal is at the high level further comprises:

determining transmittances corresponding to the different gray-scale images;

determining the gamma voltages corresponding to the different gray-scale images; and determining the gamma voltages corresponding to the transmittances in the different gray-scale images to obtain the first group of gamma voltage data.

10. The display driving method according to claim 7, wherein the debugging the gamma voltages in the different gray-scale images in the case that the PWM signal is at the low level, to obtain gamma voltage data in the case that the actual voltage value of the pixel voltage is the same with the actual voltage value of the pixel voltage corresponding to the PWM signal at the high level and taking the gamma voltage data as the second group of gamma voltage data further comprises:

determining the gamma reference data in the different gray-scale images in the case that the first group of gamma voltage reference data corresponds to the high level of the PWM signal;

debugging the gamma voltage corresponding to the PWM signal at the low level in the corresponding gray-scale until image brightness of all gray-scale images are the same with an image brightness in the gray-scale image corresponding to the PWM signal at the high level, to obtain the second group of gamma voltage reference data.

* * * * *